United States Patent [19]

Price et al.

[11] 4,138,028

[45] Feb. 6, 1979

[54] CHILD-RESISTANT SAFETY CLOSURE

[75] Inventors: James H. Price, Maumee; Ned J. Smalley, Perrysburg, both of Ohio

[73] Assignee: Owens-Illinois, Inc., Toledo, Ohio

[21] Appl. No.: 897,316

[22] Filed: Apr. 20, 1978

Related U.S. Application Data

[63] Continuation-in-part of Ser. No. 811,410, Jun. 29, 1977.

[51] Int. Cl.[2] ..... B65D 55/02; B65D 85/56; A61J 1/00

[52] U.S. Cl. ..... 215/216

[58] Field of Search ..... 215/216, 217, 218

[56] References Cited

U.S. PATENT DOCUMENTS

| | | | |
|---|---|---|---|
| 3,941,268 | 3/1976 | Owens et al. | 215/216 |
| 3,958,708 | 5/1976 | Le Brun, Jr. | 215/216 |
| 3,984,021 | 10/1976 | Uhlig | 215/216 |

*Primary Examiner*—George T. Hall
*Attorney, Agent, or Firm*—Richard B. Dence; M. E. Click; D. H. Wilson

[57] ABSTRACT

A child-resistant, safety closure for a container having a dispensing end including a threaded neck portion onto which the closure is adapted to be threadably assembled. The closure is of the type having an annular sidewall section having a flexible distal end portion provided with at least one interlocking member adapted to interlockingly engage at least one complementary interlocking member on the dispensing end of the container in such manner that interlocking engagement is achieved when the closure is in a fully closed position on the container neck portion. Removal of the closure requires manual compression of the sidewall at locations straddling the interlocking members coupled with concurrent retrogressive turning movement of the closure. An additive safety feature embodies providing a secondary interlocking engagement when the closure is partially removed. Thus, such manual manipulation ordinarily must be repeated at each successive interlocking position of the closure and is both beyond the ordinary capability of a child or other person of similar mental capabilities.

The closure features a frictionally slidable, fluid-tight sealing arrangement which in one aspect is operative to prevent leakage of the container's contents when the closure is in a fully closed position, and which in another alternative aspect is operative to prevent such leakage at and between both the fully closed and the succeeding partially removed interlocking locations of the closure on the container dispensing end.

22 Claims, 8 Drawing Figures

CHILD-RESISTANT SAFETY CLOSURE

CROSS REFERENCES TO RELATED APPLICATIONS

The present invention constitutes a continuation-in-part of co-pending application Ser. No. 811,410, filed June 29, 1977.

BACKGROUND OF THE INVENTION

1. Field of the Invention

The present invention pertains to a child-resistant, safety closure for packaging ingredients such as household chemicals, medicaments, or other ingredients, which may be dangerous and harmful to children and other persons of insufficient mental capacity to appropriately comprehend the threat of serious injury or death posed by contact with, or improper use of, such ingredients. Thus, the closure is of the type which is constructed in such manner that its removal from the container requires that a knowledgeable and purposeful thought process by employed in conjunction with a manual dexterity which is beyond the capabilities of an immature child or a person of similar mental faculties.

2. Description of the Prior Art

Heretofore, numerous versions of safety closures have been designed for the purpose of preventing children and other unknowledgeable persons from gaining access to dangerous household chemicals, medicaments and drugs such as are conventionally packaged in containers for consumer use. Among such types of safety closures are those which are of the nonreusable type associated with unit dose or single use containers. However, many types of dangerous and harmful household chemicals, are packaged for frequent, repeated usage, or dispensation, and thereby require the employment of a safety closure which is susceptible to being frequently removed and reattached on the container, while at the same time retaining the featurs of being a child-resistant, safety closure. Among the latter types of safety closures which have attained substantial commercial acceptance are those which are frequently referred to as "squeeze-and-turn" types of safety closures. Various prior art types of patented squeeze-and-turn safety closures are described in, among others, U.S. Pat. Nos. 3,984,021 and 3,376,991 which require major modifications in the shape of the container neck portion in order to accommodate adequate deformation of the safety closure in response to manual compression, or squeezing to disengage it from the container.

Another version of a squeeze-and-turn safety closure designed for use with a container having a more conventionally styled circular neck portion is described in U.S. Pat. No. 3,941,268. While the last-mentioned patent provides a safety closure construction which features such advantages as being utilizable with a container having a more conventional type of neck portion and which also provides a highly desirable secondary interlock between the safety closure and the container neck portion, the safety closure is a single sidewalled closure and, as a result, offers only limited versatility with respect to the style and design of the container with which it can be utilized. In other words, by virtue of the single sidewall construction, both the internal threaded portion of the closure and the interlocking members, of necessity, are integral components of the same sidewall. Thus, in order to provide adequate flexibility to deform, or distend, the sidewall sufficient to disengage it from the neck portion of the container, the sidewall must extend substantially beyond the threaded portion, which is rigidly engaged with the container neck portion. Also, to provide sufficient space to accommodate such deformation, the sidewall is necessarily flared outwardly from the neck of the container. Thus, the style and design of the closure is quite restricted.

An additional problem existent with most of the known safety closures resides in the common use of a sealing liner positioned on the underside surface of the closure, and which abuts and seals against the annular rim on the container neck portion to prevent leakage of the container's contents. Customarily, most of the commonly employed sealing liners are fabricated in the form of thin discs of resilient plastic material which is sufficiently pliant to accommodate small imperfections in the rim surface of the container neck portion and provide a fluid-tight seal therewith. However, it is not uncommon for such plastic sealing materials to undergo plastic flow when compressed repetitively, or for prolonged periods of time, against the annular rim on the neck portion of the container. As a result, during the course of repeated removal and replacement of the closure in order to reach a fully closed position, the closure frequently must be further and further tightened to compensate for such liner deformation. As a result, the fully closed and sealed position of the closure gradually changes and causes a corresponding change in the rotational position of the closure relative to the container neck portion. However, since the relative rotational orientation of the interlocking members provided on the container and the safety closure remains unchanged, the fully closed and sealed position of the closure no longer orientationally corresponds to the original interlocking, fully closed position, and leakage of the container's contents is apt to occur in the event that the safety closure is loosened or otherwise returned to its originally fully closed and interlocked location on the neck portion of the container. Consequently, although the safety closure may be positioned in its original fully closed position in interlocked engagement with the container, the sealing liner may have been rendered ineffective to prevent leakage of the container's contents. Thus, a child while handling the container may come into harmful or injurious contact with the contents leaking from the container.

SUMMARY OF THE INVENTION

In accordance with the present invention, a child-resistant, safety closure is provided for assemblement with a container in such manner as to preclude a child, or a person of comparable metal capability, from either removing the closure or becoming exposed to the container's contents. The safety closure features the advantages of having a sidewall construction in which an upper section of the sidewall is theadably engageable with the threaded neck portion of the container and in which a lower section of the sidewall is resiliently deformable and has its interior surface provided with interlocking members designed to interlockingly engage the dispensing end of the container, when the safety closure is in a fully closed and sealed position on the container neck portion. In the preferred form the interlocking members are additionally designed to again interlockingly engage the dispensing end of the container when the safety closure is positioned in at least one partially removed location on the threaded neck portion of the container. The resiliently deformable, or distensible, construction of the lower section of the sidewall is such that manual compression applied thereto at locations straddling the interlocking members, coupled with concurrent retrogressive rotation of the closure, will permit disengagement of the interlocking members and permit partial removal of the closure to the next interlocking location where such manual compression and retrogressive movement must ordinarily be repeated to further remove the closure.

No less importantly, the interlocking safety features of the present invention are not only combinable in a child-resistant safety closure having a single sidewall structure of the type, for example, disclosed in U.S. Pat. No. 3,941,268, discussed above, but also are advantageously combinable into a double-walled closure which provides substantial versatility with respect to the style and design of the container with which it can be employed. In this latter regard, the safety closure may alternatively include an inner sidewall which is threadably engageable with the threaded neck portion of the container and an outer sidewall which is resiliently deformable independently of the inner sidewall and has its interior surface provided with interlocking members designed to interlockingly engage the dispensing end of the container when the safety closure is in a fully closed and sealed position on the container neck portion.

In combination with the foregoing features, both the single-walled or double-walled versions of the safety closure of the present invention are provided with sealing means designed to provide a fluid-tight, back-up seal which is capable of maintaining fluid-tight sealing contact with the container neck portion even though a conventionally provided sealing liner becomes ineffective to prevent leakage of the container's contents. Moreover, the fluid-tight, back-up seal is structured in such manner that it possesses the capability of maintaining such fluid-tight sealing contact with the container neck portion even when the safety closure is partially removed through retrogressive threaded rotation from its fully closed position to the next succeeding interlocking location.

Keeping the foregoing features in mind, it is a principal objective of the present invention to provide an improved child-resistant, safety closure which in order to be removed from the container necessitates knowledgeable intent beyond the capabilities of an immature child or person of like mentality.

Another objective of the present invention is to provide a safety closure possessing the last-mentioned characteristics and which also is designed to incorporate a double sidewalled construction affording substantial design versatility to thereby render the safety closure more readily adaptable to a variety of containers having widely differing neck dimensions and proportional styling characteristics.

An additional objective of the present invention is the provision of a child-resistant, safety closure which is structured in such manner that it will interlockingly engage the dispensing end of the container both in its fully closed and sealed position on the container neck portion and also interlockingly engage the dispensing end of the container in another partially removed location on the container neck portion, to thereby provide additional protection and precaution against accidental removal by a child or comparable immature person.

A further objective of the present invention is the provision of a safety closure which in addition to possessing the characteristics of the last-mentioned objective is also capable of maintaining fluid-tight sealed relationship with the dispensing end of the container, both when located in either its fully closed position or when located in a partially removed secondary interlocking location on the container neck portion.

The specific nature of the present invention, as well as other objects and advantages thereof, will become readily apparent to those ordinarily skilled in the art from the following detailed description taken in conjunction with the annexed drawings wherein, by way of example only, certain preferred embodiments of the present invention are illustrated.

DETAILED DESCRIPTION OF THE PREFERRED EMBODIMENTS OF THE INVENTION

Figure 1:
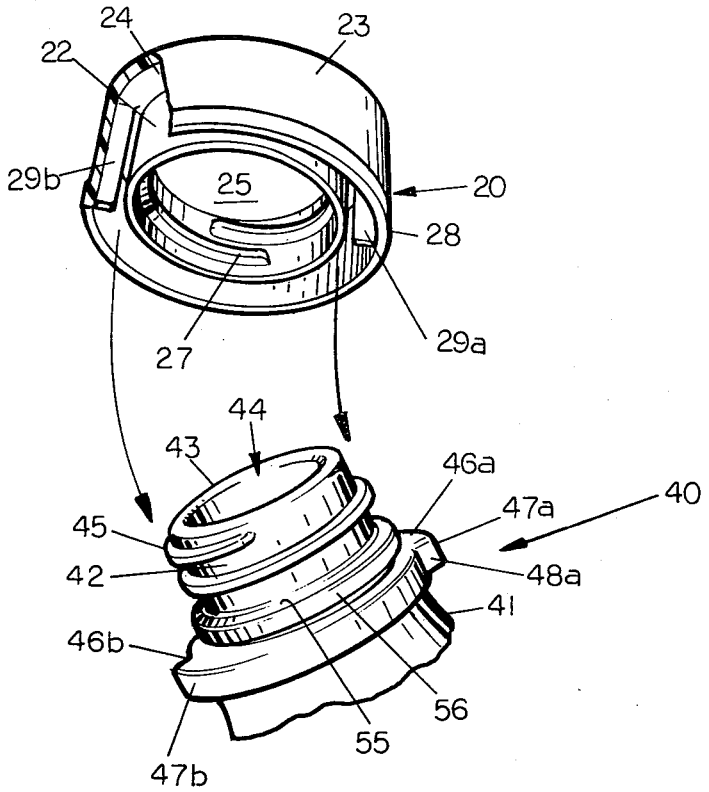
FIG. 1 is an exploded perspective view of a child-resistant, safety closure and container combination constructed in accordance with the present invention, and, for clarity of illustration, depicting the closure and container fragmentarily and in disassembled relationship.
Figure 3:
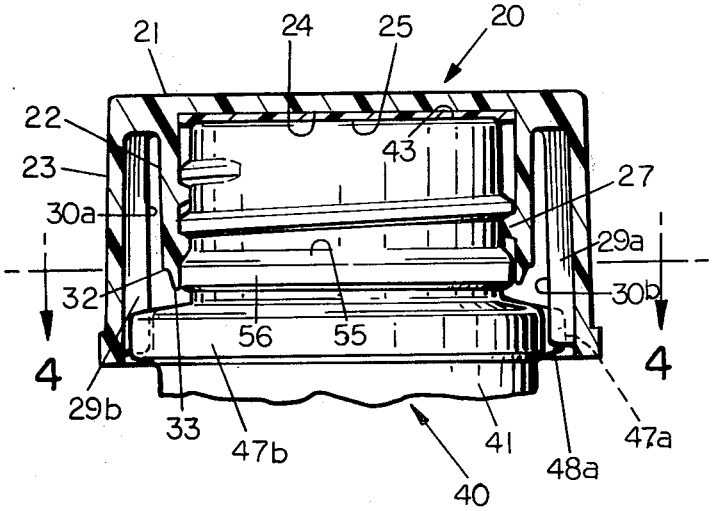
FIG. 3 is a fragmentary elevational view of the container and safety closure depicted in FIG. 1, but illustrating the safety closure in vertical central section and assembled in fully closed and interlocked engagement with the dispensing end of the container.
Figure 2:
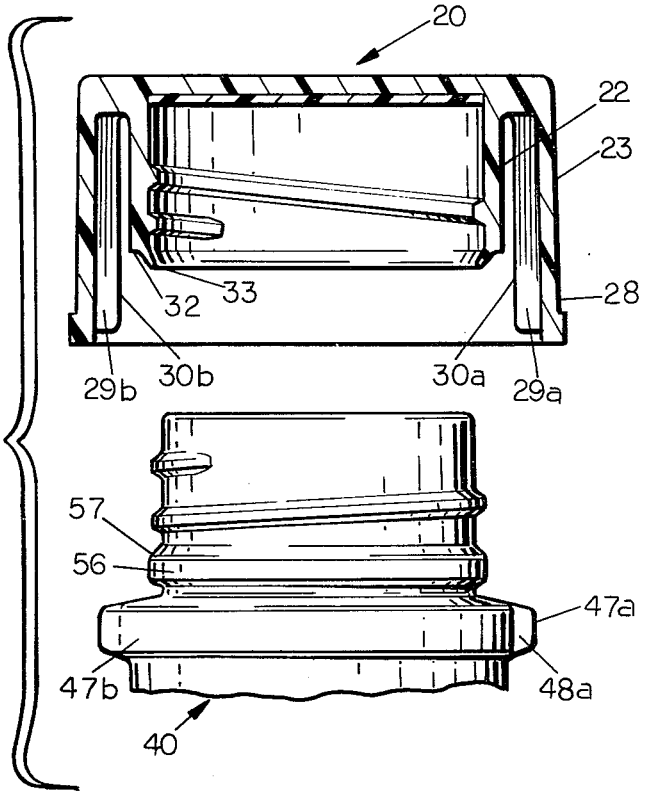
FIG. 2 is an enlarged and exploded fragmentary elevational view of the container and safety closure depicted in FIG. 1, but illustrating the safety closure in vertical central section and disassembled from the dispensing end of the container.

In accordance with one preferred embodiment of the present inventive exemplified in FIGS. 1–6, a safety closure 20 is illustrated in FIGS. 1 and 2 in disassembled overlying relationship with a container generally designated as 40; only the dispensing end 41 of which is shown and with which the closure 20 is designed to be threadable assembled and threadably advanced to a fully closed position depicted in FIG. 3. When thus assembled, the safety closure 20 is designed to interlock with the dispensing end 41 of the container 40 and resist retrogressive threaded movements necessary for normal threaded removal of the closure from the container.

As illustrated, the safety closure 20, which is preferably fabricated from a resilient plastic material, defines a generally cup-shaped overall configuration and includes a closed endwall 21 carrying depending, integral, coaxially aligned and mutually interspaced, inner and outer annular sidewalls 22 and 23, respectively. Within the confines of the inner sidewall and adhesively adhered, or otherwise suitably affixed, to the underside surface 24 of the closed endwall 21, there is preferably a sealing liner 25 which, as will subsequently be described in greater detail, is adapted to seal against the dispensing end 41 of the container 40 in fluid-tight sealed relationship when the closure 20 is assembled on the container in the fully closed position shown in FIG. 3. Provision for threadable engagement of the closure 20 on the dispensing end 41 of the container is afforded by the inner sidewall 22 which is provided with a threaded section on its interiorly facing surface defining a continuous female thread 27. The outer sidewall 23 defines a generally cylindrical configuration and is of flexible and resilient deformable construction. Also, as illustrated, the outer sidewall 23 extends axially beyond the depending end of the inner sidewall 22 to define a distal end portion 28 of generally circular cross-sectional configuration and which is adapted to cooperatively interlock with the dispensing end 41 of the container in at least two separate threadably assembled positions to be subsequently described. The means for interlocking the distal end portion 28 of the outer sidewall 23 with the dispensing end 41 of the container 40 is provided in the form of a pair of diametrically opposite and axially extending locking ribs 29*a* and 29*b* integrally formed on the interiorly facing surface of the outer sidewall and which project radially inward into the interspace between the inner and outer sidewalls 22 and 23 to define narrow interiorly facing surfaces 30*a* and 30*b*, respectively, paralleling the central longitudinal axis of the closure.

In accordance with the present invention, the safety closure 20 also features means for providing a secondary back-up seal between the inner sidewall 22 and the dispensing end 41 of the container 40. To this end, the inner sidewall 22 includes a resiliently flexible, or distensible, depending end portion 32, which is formed in such manner as to define an interiorly disposed peripheral sealing section which, as will be subsequently described, is adapted to contact the dispensing end 41 of the container 40 in frictionally slidable, fluid-tight, sealing relationship when the closure 20 is threadably assembled on the container neck portion. In more detailed respects, the resilient, depending end portion 32 of the inner sidewall 22 is shaped to form an inclined and divergently tapered annular sealing flange 33 which projects inwardly and downwardly from the inner sidewall 22.

With regard to the container 40, the dispensing end 41 thereof includes an exteriorly threaded neck portion 42 terminating in an annular rim 43, which, in turn, defines a dispensing opening at 44 communicating with the interior confines of the container. The threaded neck portion 42 may be conventionally formed with a continuous integral male thread 45 designed for complementary threaded engagement with the female thread 27 on the inner sidewall 22 of the safety closure 20 and located axially between the annular rim 43 and interlocking means integrally formed on the exterior surface of the container dispensing end 41. At a location disposed between the neck threads 45 and the interlocking means, the neck portion 42 includes a concentric peripheral shoulder 55 on the exterior surface thereof. As shown, the peripheral shoulder 55 is at least diametrically as large as the major diameter of the threads 45 and has, as shown, a plane concentric edge surface defining over essentially its entire expanse a smooth peripheral exterior sealing surface 56.

In more particular respects, the interlocking means includes a diametrically opposite, peripherally extending shoulder segments 46*a* and 46*b*, and each of which defines an eccentric peripherally, tapered, or inclined, edge surface which functions as a camming surface (designated as 47*a* and 47*b*). As illustrated, each of the camming surfaces is inclined, or peripherally enlarges, in the direction of the path of threaded attachment, or advancement, of the closure 20 onto the dispensing end 41 of the container 40 and, as best observed in FIGS. 4–6, terminates abruptly in a radial ledge, such as 48*a* and 48*b*, which forms an abutment projecting radially from the dispensing end of the container to the inclined end of the camming surface. The radial ledges 48*a* and 48*b* are strategically located at diametrically opposite peripheral locations, i.e. 180° apart, on the dispensing end 41 of the container 40, and are orientationally arranged to respectively abut against one each of the closure locking ribs 29*a* and 29*b* when the closure is threadably advanced to a fully closed position, such as is indicated in FIG. 3, and in which position the sealing liner 25 tightly seals the dispensing opening 44 of the container by bearing against and forming a fluid-tight seal with the annular rim 43. During advancement of the safety closure to its fully closed position, shown in FIG. 3, the resilient, annular sealing flange 33 on the inner sidewall 22 is caused to be advanced into sliding frictional contact with and be deflected, or distended, by the shoulder 55 into snug parallel alignment with the exterior sealing surface on the container neck portion 42. Thereafter, further advancement of the safety closure to its fully closed position causes the deflected, or distended, sealing flange 33 to firmly seat against the peripheral exterior sealing surface 56 in snug, fluid-tight, sealed relationship. Thus, when the closure 20 is advanced to its fully closed position, a secondary back-up seal is provided which is additional to the seal provided by the sealing liner 25. Additionally, as clearly shown, the sealing flange is sufficiently flexible to accommodate such deflection or distension without causing any appreciable deformation or change in the shape of the rest of the inner sidewall 22.

Also, during the course of threaded attachment, or advancement, of the safety closure 20 on the container dispensing end 41, the locking ribs 29*a* and 29*b* will, prior to reaching the fully closed position, shown in FIG. 3, individually contact the inclined camming surfaces 47*a* and 47*b*. Thereafter, further threaded advancement of the closure will cause the locking ribs 29*a* and 29*b* to flex radially outward as they ride on the gradually inclined camming surfaces 47*a* and 47*b* and thereby deform, or distend, the resiliently flexible, distal end portion 28 of the closure outer sidewall 23 sufficiently to accommodate continued manual threaded advancement of the closure to a fully closed position in which, as previously described, the sealing liner 25 on the underside surface 24 of the closed endwall 21 of the closure 20 is pressed into fluid-tight sealing contact with the annular rim 43 of the container to thereby seal the dispensing opening 44 therein. Since, as shown and described, the radial ledges 48*a* and 48*b* are arranged to orientationally correspond to the fully closed position of the closure 20 and to provide an abutment blocking each of the locking ribs and resisting attempted reverse, or retrogressive, threaded movement necessary for removal of the closure. Thus, normal threaded removal of the closure such as might be attempted by an unknowledgeable child is precluded. However, as will hereinafter be described, removal of the safety closure by a mature or knowledgeable person may be accomplished in a relatively facile manner.

Figure 4:
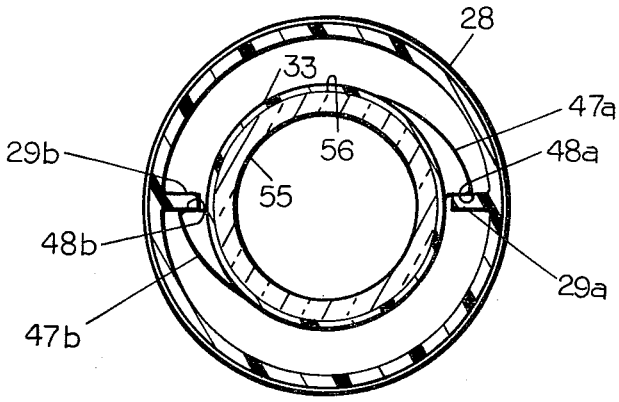
FIG. 4 is a dimensionally reduced sectional view taken along and in the direction of sectional plane 4—4 in FIG. 3.
Figure 5:
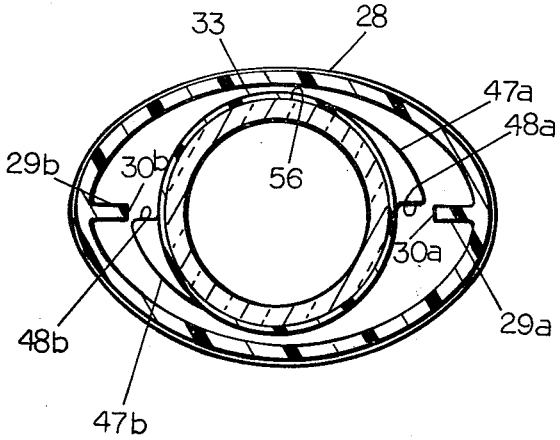
FIG. 5 is a sectional view similar to that illustrated in FIG. 4, but depicting certain functional characteristics of the invention by showing the distorted elliptical configuration of the safety closure relative to the dispensing end of the container resulting from manually compressing opposite sides of the safety closure to disengage the closure from interlocking engagement with the container.
Figure 6:
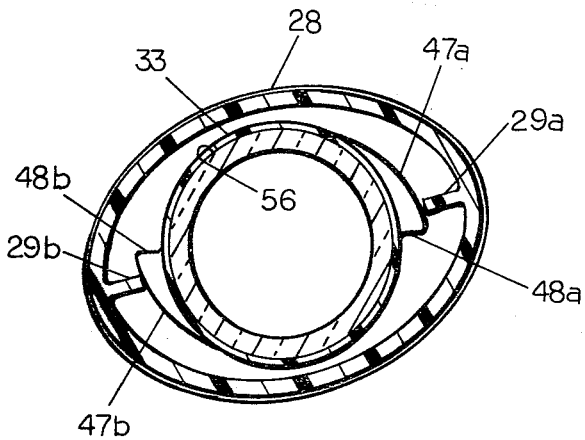
FIG. 6 is another sectional view similar to FIG. 4, but further showing the distorted closure removably or retrogressively rotated a fractional revolution subsequent to disengagement of the child-resistant interlock.

As best depicted in FIGS. 4–6, to accomplish threaded removal of the closure 20, the locking ribs 29*a* and 29*b* must first be disengaged from interlocking engagement, or abutment, with the radial ledges 48*a* and 48*b*. Such disengagement from the interlocking engagement may be readily accomplished by manually compressing the resiliently deformable, distal end portion 28 of the closure outer sidewall 23 at peripheral locations straddling the location of interlocking engagement to thereby deform, or distend, the outer sidewal 23 of the closure 20 from its normal generally cylindrical configuration (FIG. 4) to a generally elliptical configuration depictded in FIG. 5. Such manual compression coupled with concurrently applied retrogressive rotation of the closure 20 permits the locking ribs 29*a* and 29*b* to override the radial ledges 48*a* and 48*b*, as depicted in FIG. 6, and allows further retrogressive rotation of the closure.

Preferably, the axial height, or extent, of the camming surfaces 47*a*, 47*b* and their respective radial ledges 48*a*, 48*b* is such that they will again intercept the locking ribs 29*a* and 29*b* when the closure 20 has been retrogressively rotated one-half threaded turn, or 180°, from its fully closed position. Thus, removal of the closure will require repetition of the procedure described above with respect to FIGS. 4–6. Although it is possible to maintain continued manual compression and concurrent retrogressive rotation of the closure sufficiently to rotate the closure in excess of 180° to avoid a secondary interlocking, the necessary manual dexterity required is quite difficult even for a person possessing knowledge of the operational characteristics of the interlocking members, and more importantly is beyond the ordinary capabilities of an immature child. Otherwise stated, once the closure 20 has been retrogressively shifted to the position indicated in FIG. 5, manual compression will ordinarily be released in favor of a succession of normal twisting movements; each of which is customarily much less than 180° in extent. Thus, a second interlocking engagement between the closure and container will ordinarily result and will require a repetition of the compressive and turning movements described with respect to FIGS. 4–6. Keeping the foregoing in mind, it is exceedingly unlikely that an immature child would possess the requisite comprehension to premeditatively apply the necessary repetitious manual compression and concurrent retrogressive rotation, particularly at peripheral locations straddling the interlocking locations, necessary to remove the closure from the container. In other words, although an immature child possibly might accidentally disengage the closure from its initial fully closed and interlocked position on the dispensing end of the container, the liklihood of repetition of such accidental disengagement from the next sequential interlocking location, removed 180° from the fully closed position, is extremely remote.

Figure 7:
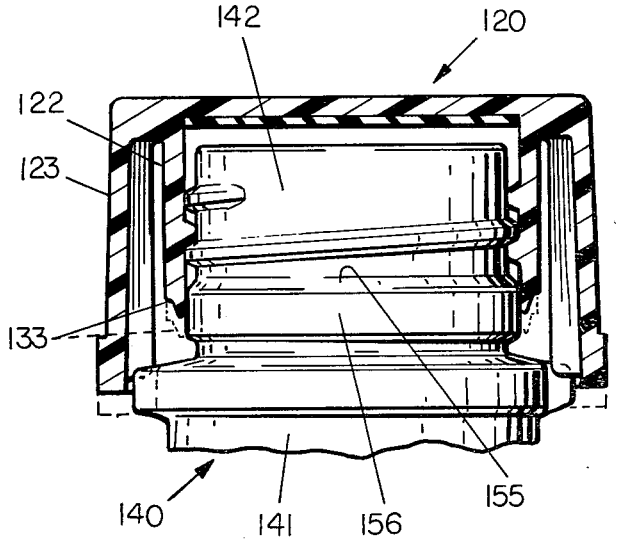
FIG. 7 is a centrally sectioned elevational view of an alternative embodiment of the invention and incorporating a sealing feature designed to be operable when the safety closure is in assembled and interlocked engagement with the dispensing end of the container at a location retrogressively rotated, or threadably removed, 180° from the fully closed position shown in broken lines.

In an alternative embodiment of the invention shown in FIG. 7, the closure 120 and the dispensing end 141 of the container have been modified slightly to provide a continuous fluid-tight seal throughout the course of removal of the closure from a fully closed position (indicated by broken lines) to a second partially removed interlocking position, such as described above, located one-half revolution, or 180°, removed from the fully closed position. As modified, the neck portion 142 of the container has been axially lengthened to accommodate a lengthening of the peripheral shoulder 155 and its exterior peripheral sealing surface 156 sufficiently to accommodate continuous sealing contact between the sealing surface 156 and the annular sealing flange 133 as the latter moves upwardly with the closure during retrogressive rotation of the closure through 180° from its fully closed, interlocking position to its next interlocking position. Similarly, the outer sidewall 123 and the depending end of the inner sidewall 122 have been axially lengthened to correspond to the lengthening of the container neck portion.

Figure 8:
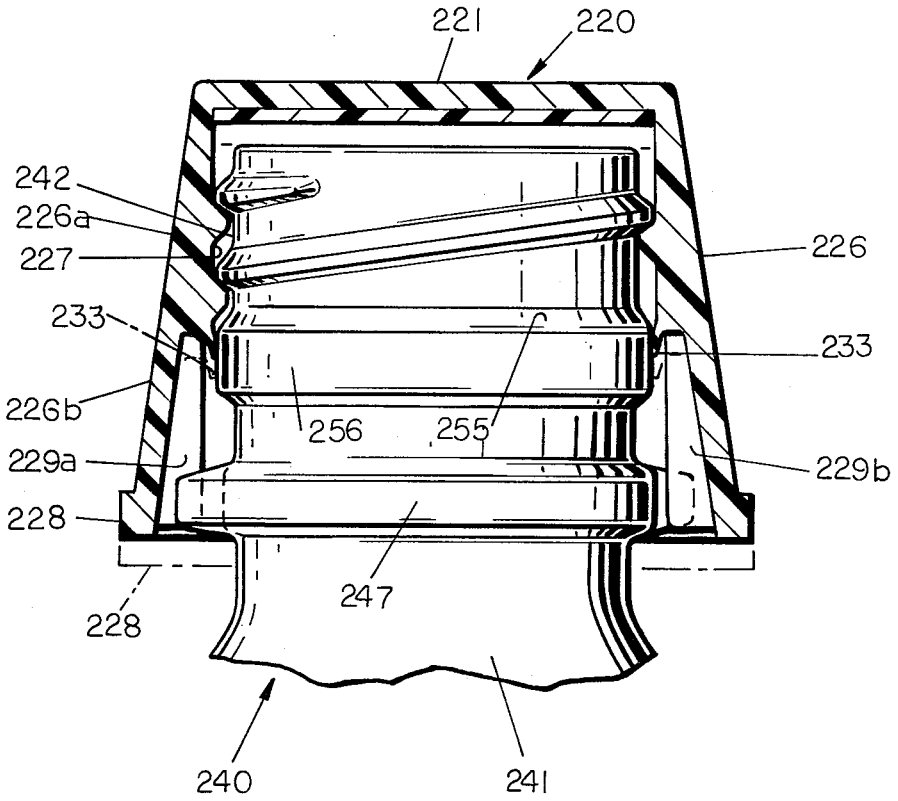
FIG. 8 is another centrally sectioned elevational view of a further alternative embodiment wherein the innovative features of the present invention are incorporated into a child-resistant safety closure having a single sidewall structure.

FIG. 8 represents a further alternative embodiment of the invention and depicts the child-resistant safety closure 220 constructed with a single sidewall structure. In the assembled position shown, the safety closure 220 is arranged in a manner comparable to FIG. 7 with the safety closure in a partially removed and interlocked position on the threaded neck portion 242 of a container 240. Otherwise stated, the safety closure 220 is depicted as being partially threadably removed, or retrogressed, from the interlocking position corresponding to its fully closed and sealed position (indicated by broken lines) to the next succeeding interlocking position (shown in solid lines). Also, consistent with certain of the features described in FIG. 7, the dispensing end 241 of the container 240 has been modified slightly by being axially lengthened. The axial lengthening of the dispensing end 241 serves to provide a greater axial interspacing between the camming surface 247 and the smoothly surfaced concentric sealing surface 256 defined on the peripheral shoulder 255. Also, as with the embodiment shown in FIG. 7, such axial lengthening of the dispensing end accommodates increased axial lengthening of the exterior peripheral sealing surface 156, and thereby provides a sealing surface of suffient axial expanse to accommodate continuous, frictional, fluid-tight, sealing contact between the sealing surface 256 and the flexible, annular sealing flange 233 provided within the safety closure 220 during threaded movement of the closure between its respective fully closed and partially removed interlocking positions. Additionally, as shown, the safety closure 220 has been modified in such manner that the double sidewall structure of the previously described embodiments has been replaced with a single annular sidewall 226, which depends integrally from the closure endwall 221 and defines a generally frusto-conical configuration gradually enlarging in diametrical size in a direction approaching the open end thereof. In the single sidewall embodiment of FIG. 8, the sidewall 226 includes an annular upper sidewall portion, or section, 226*a* and a lower sidewall portion, or section, 226*b*, the latter of which constitutes an integral continuation of the upper sidewall section 226*a* which terminates in a flexible and resiliently deformable distal end portion 228, which is capable of being deformed, as described with respect to FIGS. 4–6, in response to compression manually applied by exterior finger pressure, or the like.

The upper sidewall section 226a is provided at its lower extremity with an integral, interiorly projecting annular, sealing flange 233 of resiliently distensible properties. As shown, the sealing flange 233 tapers divergently inwardly and downwardly from the upper sidewall section and is adapted to seat and resiliently distend against the exterior sealing surface 256 on the container neck portion to provide a snugly conforming, fluid-tight, frictional seal therewith. As shown, the sealing flange 233 is designed to be sufficiently flexible to distend and seat against the sealing surface 256 without causing any appreciable distortion or alteration in the dimensional or configurational characteristics of the rest of the closure sidewall. Intermediate the sealing flange 233 and the endwall 221 of the safety closure, the upper section 226a defines an interiorly threaded portion 227 adapted to threadably engage the threaded neck portion 242 of the container 240.

Sequential interlocking engagement is effected between the safety closure 220 and the dispensing end of the container 240 in the same general manner accomplished in the previously described embodiments. Thus, in the preferred form shown in FIG. 8, a pair of interlocking members are provided in the form of a pair of generally axially extending and radially inwardly projecting ribs 229a and 229b, arranged in diametrically opposed locations on the interior surface of the lower sidewall section 226b. The manner of interlocking, camming and sequential release of interlocking engagement of the ribs 229a and 229b with respect to the ledges on the camming surface 247 are accomplished in the same manner as described with respect to the preceding embodiments of the invention. Also, the feature of maintaining a fluid-tight seal between the distensible sealing flange 233 and the exterior sealing surface 256 on the container neck portion during the course of rotative removal of the closure from its fully closed position and interlocking position (shown in broken lines) to the next partially removed and interlocking position (sold lines) remains essentially unchanged from that described with respect to the preceding embodiment depicted in FIG. 7.

While the foregoing embodiments have been shown and described as having only two sequential interlocking locations corresponding to the fully closed position of the closure on the dispensing end of the container and a position in which the closure has been retrogressively rotated 180°, it will be readily apparent that, if desired, additional sequential interlocking locations may be provided by longitudinally extending the radial ledges sufficiently to intercept the locking ribs at additional locations during removal of the closure. Additionally, the distensible sealing flange on the sidewall of the safety closure and the peripheral exterior sealing surface on the container neck portion may be axially extended to provide a continuous fluid-tight seal coextensive with such additional interlocking positions of the closure.

Thus, an axially slidable fluid-tight, back-up seal is maintained between the child-resistant, safety closure and the dispensing end of the container even though the sealing liner may fail to provide a proper seal or the safety closure becomes substantially displaced from the fully closed and interlocked position on the container. Consequently, effective assurance is provided that there is little, if any, liklihood of escape of the container's contents or resultant accessibility thereof to a young child.

Although the present invention has been illustrated and described in a preferred embodiment employing a closure having a pair of diametrically opposite locking ribs and a complementary pair of camming surfaces, or radial ledges, it will be readily apparent that one such locking rib together with one or more camming surfaces would also be effective and possibly be desirable in certain instances without detracting from the basic features of the present invention. Moreover, it will be clearly apparent that the interlocking members may be reversed in such manner that the camming surface, or surfaces, with their accompanying radial ledge, or ledges, are provided on the interior surface of the outer sidewall of the closure, and correspondingly the locking rib, or ribs, are provided on the exterior surface of the dispensing end of the container.

It will, of course, be understood that various details of construction, combination and assembly may be modified throughout a range of equivalents, and it is, therefore, not the purpose to limit the scope of the present invention otherwise than as necessitated by the scope of the appended claims.

We claim:

1. In a child-resistant safety closure adapted for threadable attachment on a container having a generally cylindrical hollow dispensing end including an exteriorly threaded neck portion, an annular rim defining a dispensing opening, an interlocking member orientationally arranged to interlock said closure on said dispensing end when said closure is threadably advanced to a fully closed position on said neck portion, and a peripheral shoulder having a concentric edge surface defining a continuous smoothly surfaced exterior sealing surface disposed between said threaded neck portion and said interlocking member, said closure comprising:

a closed end wall provided with sealing means on the underside surface thereof arranged to seal said dispensing opening in fluid-tight sealed relationship, annular means depending integrally from said closed end wall and forming a sidewall, said means defining a threaded interior surface portion and having a distal end portion projecting axially beyond said threaded interior surface portion and defining a generally circular cross-sectional configuration, said distal end portion being sufficiently flexible to deform from a generally circular configuration to a generally elliptical cross-sectional configuration in response to manual compression of diametrically opposite sides thereof and being sufficiently resilient to essentially resume said generally circular cross-sectional configuration promptly upon release of said manual compression, said threaded interior surface portion being threadably engageable with the threaded neck portion of said container to accommodate threaded advancement of said closure on said neck portion to said fully closed position in which said sealing means assumes fluid-tight sealing relationship with said dispensing opening;

an interlocking member integrally formed on the distal end portion of said closure and adapted to override interlocking engagement with the interlocking member on said container in response to normal threaded advancement of said closure on said neck portion, but to intercept the latter interlocking member in interlocking engagement in response to normal threaded retrogressive movement of said closure on said neck portion, and said interlocking engagement being releasable in response to manual compression and concurrent threaded retrogressive movement applied to a resiliently distensible annular sealing flange projecting divergently inward from said sidewall and said interlocking engagement;

the improvement wherein said sidewall of said closure includes a resiliently distensible annular sealing flange projecting divergently inward from said sidewall and adapted to seat against the peripheral exterior sealing surface on the dispensing end of said container in continuous, peripheral, fluid-tight, sealing relationship when said closure is threadably advanced to said fully closed position on the threaded neck portion of said container.

2. In a child-resistant safety closure as defined in claim 1, wherein said sealing flange tapers inwardly and downwardly from said closure.

3. In a child-resistant safety closure as defined in claim 1, wherein said sealing flange is sufficiently flexible to distend and seat against said exterior sealing surface on said container in fluid-tight sealing relationship without causing any appreciable change in the shape of the rest of said sidewall.

4. In a child-resistant safety closure as defined in claim 3, wherein said sealing flange is adapted to distend and seat in snug parallel alignment with the exterior sealing surface on said container.

5. In a child-resistant safety closure as defined in claim 4, wherein the sidewall formed by said annular means provides a unitary sidewall commonly and integrally shared by said threaded interior surface portion, said sealing flange and said distal end portion of said closure.

6. In a child-resistant safety closure as defined in claim 5, wherein said sidewall defines a generally frustoconical configuration enlarging in size approaching the distal end portion thereof.

7. In a child-resistant safety closure as defined in claim 6, wherein the closure interlocking member projects radially inward from the distal end portion of said closure.

8. In a child-resistant safety closure and container combination comprising:

a container having a generally cylindrical hollow dispensing end including an exteriorly threaded neck portion and an annular rim defining a dispensing opening;

a closure for said container having a closed end wall provided with sealing means on the underside surface thereof arranged to seal said dispensing opening in fluid-tight sealed relationship, and annular means depending integrally from said closed end wall and forming a sidewall, said means defining a threaded interior surface portion and having a distal end portion projecting axially beyond said threaded interior surface portion and defining a generally circular cross-sectional configuration, said distal end portion being sufficiently flexible to deform from said generally circular cross-sectional configuration to a generally elliptical cross-sectional configuration in response to manual compression of diametrically opposite sides thereof and being sufficiently resilient to essentially resume said generally circular cross-sectional configuration promptly upon release of said manual compression, said threaded interior surface portion being threadably engageable with the threaded neck portion of said container to accommodate threaded advancement of said closure on said neck portion to a fully closed position in which said sealing means assumes fluid-tight sealing relation with said dispensing opening;

cooperative interlocking means including interlocking members integrally formed on the distal end portion of said closure and on the dispensing end of said container, said interlocking members being arranged to override interlocking engagement with each other in response to normal threaded advancement of said closure on said neck portion and to intercept each other in interlocking engagement in response to normal threaded retrogressive movement of said closure on said neck portion, and said interlocking engagement being releasable in response to manual compression and concurrent threaded retrogressive movement applied to the distal end portion of said closure at peripheral locations straddling said interlocking engagement; and said interlocking members being arranged to interlock at a location corresponding to the fully closed position of said closure, whereby manual compression coupled with concurrent threaded retrogressive movement must be premeditatively applied to the distal end portion of said closure at peripheral locations straddling said interlocking location in order to threadably remove said closure from said neck portion;

the improvement wherein the dispensing end of said container includes a peripheral shoulder having a concentric edge surface defining over substantially the entire expanse thereof a smooth peripheral exterior sealing surface, said threaded neck portion being disposed between said exterior sealing surface and said annular rim, and wherein the inner sidewall of said closure includes a resiliently distensible annular sealing flange projecting divergently inward from said sidewall and adapted to seat against said exterior sealing surface in continuous peripheral fluid-tight sealing relationship when said closure is threadably advanced to said fully closed position on said neck portion.

9. In a child-resistant safety closure and container combination as defined in claim 8, wherein said sealing flange tapers inwardly and downwardly from said closure.

10. In a child-resistant safety closure and container combination as defined in claim 8, wherein said sealing flange is sufficiently flexible to distend and seat against said exterior sealing surface on said container in fluid-tight sealing relationship without causing any appreciable change in the shape of the rest of said sidewall.

11. In a child-resistant safety closure and container combination as defined in claim 10, wherein said sealing flange is adapted to distend and seat in snug parallel alignment with the exterior sealing surface on said container.

12. In a child-resistant safety closure and container combination comprising:

a container having a generally cylindrical hollow dispensing end including an exteriorly threaded neck portion and an annular rim defining a dispensing opening;

a closure for said container having a closed end wall provided with sealing means on the underside surface thereof arranged to seal said dispensing opening in fluid-tight sealed relationship, and an integral concentric pair of annular depending inner and outer sidewalls arranged in radially interspaced relationship, said outer sidewall having a distal end portion projecting axially beyond said inner sidewall and defining a generally circular cross-sectional configuration, said distal end portion being sufficiently flexible to deform from said generally circular cross-sectional configuration to a generally elliptical cross-sectional configuration in response to manual compression of diametrically opposite sides thereof and being sufficiently resilient to essentially resume said generally circular cross-sectional configuration promptly upon release of said manual compression, said inner sidewall defining a threaded interior surface portion threadably engageable with the threaded neck portion of said container to accommodate threaded advancement of said closure on said neck portion to a fully closed position in which said sealing means assumes fluid-tight sealing relation with said dispensing opening;

cooperative interlocking means including interlocking members integrally formed on the distal end portion of said closure and on the dispensing end of said container, said interlocking members being arranged to override interlocking engagement with each other in response to normal threaded advancement of said closure on said neck portion and to intercept each other in interlocking engagement in response to normal threaded retrogressive movement of said closure on said neck portion, and said interlocking engagement being releasable in response to manual compression and concurrent threaded retrogresive movement applied to the outer sidewall of said closure at peripheral locations straddling said interlocking engagement; and said interlocking members being arranged to interlock in sequential interlocking locations orientationally related respectively to at least two separate threadably engaged positions of said closure on said neck portion, one of said interlocking locations being arranged to correspond to said fully closed position of said closure and another of said interlocking locations being disposed to substantially precede arrival of said closure in said fully closed position, whereby manual compression coupled with concurrent threaded retrogressive movement customarily must be repetitiously and premeditatively applied to the distal end portion of said closure at peripheral locations straddling interlocking locations in order to threadably remove said closure from said neck portion;

the improvement wherein the dispensing end of said container includes a peripheral shoulder having a concentric edge surface defining over essentially the entire surface thereof a smooth peripheral exterior sealing surface, said threaded neck portion being disposed between said exterior sealing surface and said annular rim, and wherein the inner sidewall of said closure includes a resiliently distensible annular sealing flange projecting divergently inward from said sidewall and adapted to seat against said exterior sealing surface in continuous peripheral fluid-tight sealing relationship when said closure is threadably advanced to said fully closed position on said neck portion.

13. In a child-resistant safety closure and container combination as defined in claim 12, wherein said sealing flange is disposed in an inclined relationship relative to said inner sidewall.

14. In a child-resistant safety closure and container combination as defined in claim 13, wherein said sealing flange tapers divergently from said inner sidewall.

15. In a child-resistant safety closure and container combination as defined in claim 12, wherein the exterior sealing surface of said container is of sufficient axial extent to maintain continuous fluid-tight sealing relationship with the sealing flange of said closure when said closure is displaced from said fully closed position on said neck portion.

16. In a child-resistant safety closure and container combination as defined in claim 12, wherein the exterior sealing surface on said container is at least diametrically as large as the major diameter of the threads on the threaded neck portion thereof.

17. In a child-resistant safety closure and container combination as defined in claim 12, wherein said exterior sealing surface of said container is of sufficient axial extent to maintain continuous sealing contact with said sealing flange of said closure throughout threaded retrogressive movement of said closure between the interlocking location corresponding to said fully closed position and the next sequential interlocking location.

18. In a child-resistant safety closure and container combination as defined in claim 17, wherein the last-mentioned interlocking location is disposed one-half threaded revolution preceding arrival of said closure in said fully closed position.

19. In a child-resistant safety closure adapted for threadable attachment on a container having a generally cylindrical hollow dispensing end including an exteriorly threaded neck portion, an annular rim defining a dispensing opening, an interlocking member orientationally arranged to interlock said closure on said dispensing end when said closure is threadably advanced to a fully closed position on said neck portion, and a peripheral exterior sealing surface disposed between said threaded neck portion and said interlocking member, said closure comprising:

a closed end wall provided with sealing means on the underside surface thereof arranged to seal said dispensing opening in fluid-tight sealed relationship, an annular interiorly threaded sidewall portion and an annular distal end portion depending integrally from said closed end wall, said interiorly threaded sidewall portion being threadably engageable with the threaded neck portion of said container to accommodate threaded advancement of said closure on said neck portion to said fully closed position in which said sealing means assumes fluid-tight sealing relationship with said dispensing opening;

said distal end portion projecting axially beyond said interiorly threaded sidewall portion and having a generally circular cross-sectional configuration, said distal end portion being sufficiently flexible to deform from a generally circular configuration to a generally elliptical cross-sectional configuration in response to manual compression of diametrically opposite sides thereof and being sufficiently resilient to essentially resume said generally circular cross-sectional configuration promptly upon release of said manual compression.

an interlocking member integrally formed on said distal end portion and adapted to override interlocking engagement with the interlocking member on said container in response to normal threaded advancement of said closure on said neck portion, but to intercept the latter interlocking member in interlocking engagement in response to normal threaded retrogressive movement of said closure on said neck portion, and said interlocking engagement being releasable in response to manual compression of said distal end portion and concurrent threaded retrogressive movement applied to said closure;

the improvement wherein said closure includes an interiorly disposed resiliently flexible annular sealing flange arranged to seat against the peripheral exterior sealing surface on the dispensing end of said container in continuous, peripheral, fluid-tight, sealing relationship when said closure is theadably advanced to a fully closed position on the threaded neck portion of said container, said sealing flange being disposed concentrically within said closure between said interiorly threaded sidewall portion and said distal end portion and projecting divergently inward towards the central axis of said closure, and said sealing flange being essentially independently flexible relative to said interiorly threaded and distal end portions of said closure to thereby accommodate resilient deflection of said sealing flange by the exterior sealing surface of said container without producing an appreciable change in shape in the interiorly threaded and distal end portions of said closure.

20. In a child-resistant safety closure as defined in claim 19, wherein said sealing flange is located proximately adjacent to said interiorly threaded sidewall portion of said closure.

21. In a child-resistant safety closure as defined in claim 20, wherein said interiorly threaded sidewall portion and said distal end portion are respectively portions of separate concentrically interspaced inner and outer sidewalls depending integrally from the closed endwall of said closure.

22. In a child-resistant safety closure as defined in claim 20, wherein said interiorly threaded sidewall portion and said distal end portion are both integral portions of a commonly shared sidewall of said closure.

* * * * *